US007508288B2

(12) United States Patent
Van Glabeke

(10) Patent No.: US 7,508,288 B2
(45) Date of Patent: Mar. 24, 2009

(54) MAGNETIC SWITCH ARRANGEMENT

(75) Inventor: Pierre Van Glabeke, Eeklo (BE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 11/561,764

(22) Filed: Nov. 20, 2006

(65) Prior Publication Data

US 2007/0109084 A1 May 17, 2007

Related U.S. Application Data

(63) Continuation of application No. PCT/SE05/00743, filed on May 19, 2005.

(30) Foreign Application Priority Data

May 19, 2004 (SE) ..... 0401311

(51) Int. Cl.
*H01H 9/00* (2006.01)

(52) U.S. Cl. ..... 335/207; 335/131; 335/205

(58) Field of Classification Search ..... 335/151, 335/207

See application file for complete search history.

(56) References Cited

U.S. PATENT DOCUMENTS 3,147,305 A * 9/1964 Lindley, Jr. ..... 335/2
3,205,323 A * 9/1965 Deshautreaux, Jr. ..... 335/207
3,320,562 A * 5/1967 Germanton ..... 335/207
3,489,971 A * 1/1970 Alley ..... 335/207
3,659,734 A * 5/1972 Fuzzell ..... 414/701
3,735,298 A * 5/1973 Colby ..... 335/206
4,038,620 A * 7/1977 Shlesinger et al. ..... 335/153
4,064,755 A * 12/1977 Bongort et al. ..... 73/313
4,186,362 A * 1/1980 Kondo et al. ..... 335/205
4,271,763 A * 6/1981 Berger ..... 104/179
4,509,029 A * 4/1985 Bradley ..... 335/208
4,943,791 A * 7/1990 Holce et al. ..... 335/153
5,128,641 A * 7/1992 Posey ..... 335/151
5,293,523 A * 3/1994 Posey ..... 335/205
5,877,664 A * 3/1999 Jackson, Jr. ..... 335/205
5,909,163 A * 6/1999 Posey ..... 335/151
5,916,463 A * 6/1999 Hoving et al. ..... 219/121.85
6,294,971 B1 * 9/2001 Martich ..... 335/151
6,313,724 B1 * 11/2001 Osterweil ..... 335/207
6,340,924 B1 * 1/2002 Shimizu et al. ..... 335/151

(Continued)

FOREIGN PATENT DOCUMENTS

CH 460127 9/1968

(Continued)

*Primary Examiner*—Elvin G Enad
*Assistant Examiner*—Mohamad A Musleh
(74) *Attorney, Agent, or Firm*—Novak Druce + Quigg LLP

(57) ABSTRACT

Magnetic switch arrangement including a first magnetic system (24), a second magnetic system (25) and a magnetic switching element (18). The first magnetic system (24) is arranged for biasing the magnetic switching element (18) and the second magnetic system (25) is arranged to interact with the biasing magnetic field from the first magnetic system at the magnetic switching element so that the magnetic switching element is in a predefined state. The first magnetic system (24) also includes a magnetic field assembler (19) arranged for creating a longitudinal magnetic field inside the assembler. An advantage of the invention being to provide a magnetic switch arrangement which compensates for the angular sensitivity of the switching element.

12 Claims, 4 Drawing Sheets

U.S. PATENT DOCUMENTS

| | | | | |
|---|---|---|---|---|
| 6,628,741 | B2 * | 9/2003 | Netzer | 377/21 |
| RE38,381 | E * | 1/2004 | Martich | 335/151 |
| 6,972,651 | B2 * | 12/2005 | Aoki et al. | 335/207 |
| 2003/0169138 | A1 * | 9/2003 | Motta | 335/151 |
| 2005/0077989 | A1 * | 4/2005 | Edmonson, Jr. | 335/207 |
| 2006/0208840 | A1 * | 9/2006 | Naka et al. | 335/207 |

FOREIGN PATENT DOCUMENTS

| | | |
|---|---|---|
| DE | 1810153 | 6/1969 |
| FR | 1404208 | 8/1964 |

* cited by examiner

MAGNETIC SWITCH ARRANGEMENT

CROSS-REFERENCE TO RELATED APPLICATIONS

The present application is a continuation patent application of International Application No. PCT/SE2005/000743 filed 19 May 2005 which is published in English pursuant to Article 21(2) of the Patent Cooperation Treaty and which claims priority to Swedish Application No. 0401311-6 filed 19 May 2004. Said applications are expressly incorporated herein by reference in their entirety.

FIELD

The present invention relates to a magnetic switch arrangement comprising first and second magnetic systems and a magnetic switching element. The first magnetic system is arranged for biasing the magnetic switching element and the second magnetic system is arranged to interact with the biasing magnetic field from the first magnetic system at the magnetic switching element so that the magnetic switching element is in a predefined state. In a related embodiment, the invention takes the form of a method for obtaining a differential magnetic switch arrangement with a predefined state, comprising the first and second magnetic systems and a magnetic switching element. The second magnetic system comprises two equally polarized permanent magnets that are positioned at a predefined distance apart. Among other benefits, this magnetic switch method and arrangement provides an improved magnetically operated switch.

BACKGROUND

In modern vehicles, there are many functions that are controlled electronically. Some of these functions are of the on/off type, some can be switched to several positions and some are analogue. Directly coupled switches and sensors control most functions, but some functions require a contact-free (contactless) operation. An example of functions where contact-free operation is preferred includes ABS-sensors (ABS=Automatic Brake System), chassis height detection or switches that are exposed to weather, pollution and direct friction. One kind of contact-free switches and sensors are based on a magnetic principle. There exist different types of magnetic detectors such as reed-contacts, hall-sensors and other kinds of integrated magnetic detectors. A magnetic field is used to influence the detector. The detector and the magnet thus form the switch or the sensor.

To obtain a switch or a sensor with a high resolution and which at the same time is insensitive to external magnetic fields, it is desirable to position the magnet and the detector close to each other. In this way, it is possible to use a detector with a low sensitivity, obtaining a switch or a sensor that is not influenced by (insensible to) external magnetic fields.

One problem with magnetic switches and sensors is that the sensitivity of the detector must increase with an increased detection distance. For some applications, especially for magnetic switches, it may be possible to overcome the increased distance with a larger or stronger magnet having a stronger magnetic field.

A problem with the detector being very sensitive is that it will more easily be disturbed by an external, interfering magnetic field. This can, for instance, occur when the sensor is close to a high current cable or a large transformer. Thus, it is preferred not to raise the sensitivity too much for the detector.

A problem that arises when the magnetic field is increased by using a larger magnet is that the magnetic field is not only stronger, it is also more distributed in space. This gives the effect that, when an analogue detector is used, the resolution will be degraded due to the imprecise magnetic field.

Due to the nature and to the production process of permanent magnets, the magnetic properties for magnets can vary considerably, even if they are manufactured in the same batch and at the same time. Properties of the magnet that can vary include the magnetic remanence and the direction of the magnetic field. These varying properties in turn can cause magnetic switches and sensors to behave differently even if the specifications are equal. In production, this can cause considerable problems with making adjustments and the number of rejected parts (defects).

SUMMARY

The object of the invention is therefore to provide an improved magnetic switch arrangement that is less sensitive to variations in the angular sensitivity of the used magnetic switching element.

In a first embodiment, the invention takes the form of a magnetic switch arrangement that includes a first magnetic system, a second magnetic system and a magnetic switching element. The first magnetic system is arranged for biasing the magnetic switching element and the second magnetic system is arranged to interact with the biasing magnetic field from the first magnetic system at the magnetic switching element so that the magnetic switching element is in a predefined state. The object of the invention is achieved in that the first magnetic system also includes a magnetic field assembler arranged for creating a longitudinal magnetic field inside the assembler.

By this first embodiment of the magnetic switch arrangement, an improved differential magnetic switch is obtained. The advantage of this is that the magnetic field assembler creates a uniform magnetic field for the magnetic switching element. The angular sensitivity of the magnetic switching element is thus compensated for.

In an advantageous further development of the magnetic switch arrangement according to the present invention, the second magnetic system includes two equally polarized permanent magnets positioned at a predefined distance apart. The advantage of this is an improvement in the tolerance towards deviations in the magnetic properties of the used permanent magnets.

In an advantageous further development of the magnetic switch arrangement according to the invention, the space between the magnets and/or the sides opposite the space between the magnets is/are supplied with a ferro-magnetic material. This makes it possible to adapt the magnetic switch to the desired requirements by controlling the magnetic field.

In yet a further advantageous development of the instant arrangement, the magnets of the second magnetic system are positioned such that any deviation in the magnetic field direction with respect to the symmetry axis for each magnet is symmetric in respect to a central line between the magnets. This compensates for any deviation in the direction of the magnetic field of each magnet.

In yet still another advantageous development of the magnetic switch arrangement according to the invention, the magnets of the second magnetic system are obtained by dividing a single magnet into two equal parts along a line parallel to the symmetry axis and where one magnet is rotated 180 degrees around its symmetry axis. This compensates for any deviation in the direction of the magnetic field of each magnet and creates a magnetic system with a magnetic field that is symmetric.

In one advantageous development of the magnetic switch arrangement according to the invention, the magnetic switch arrangement is integrated in one housing. The advantage of this is that an integrated magnetic switch is obtained that does not require an external magnet to function. In an advantageous further development of the magnetic switch arrangement according to the invention, the magnetic switch arrangement is a normally open switch. The advantage of this is that it can be connected to a suitable electrical logic system.

In an advantageous further development of the magnetic switch arrangement according to the invention, the magnetic switch arrangement is a normally closed switch. The advantage of this is that it can be connected to a suitable electrical logic system.

In an advantageous further development of the magnetic switch arrangement according to the invention, the magnetic switch arrangement is switched by bringing a ferromagnetic material close to the magnetic switch arrangement. The advantage of this is that the magnetic switch arrangement can be used to detect, for instance, whether a door is closed.

In an advantageous further development of the magnetic switch arrangement according to the invention, the magnetic switch arrangement is switched by removing a ferromagnetic material from the magnetic switch arrangement. The advantage of this is that the magnetic switch arrangement can be used to detect, for instance, when a door is opened.

BRIEF DESCRIPTION OF THE DRAWINGS

The invention will be described in greater detail in the following, with reference to the embodiments that are shown in the attached drawings, in which.

DETAILED DESCRIPTION

The embodiments of the invention, with further developments described in the following, are to be regarded only as examples and in no way limit the scope of the protection provided by the patent claims.

Figure 1A:
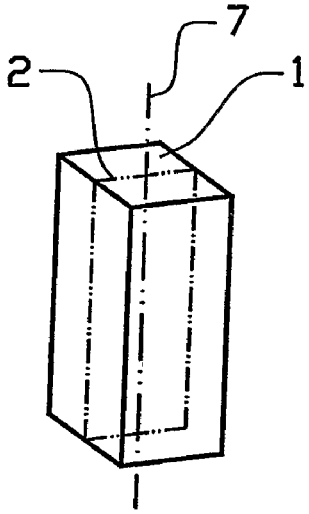
FIG. 1*a* shows a known magnet.
Figure 1B:
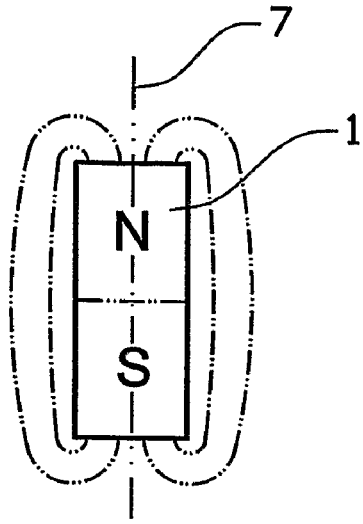
FIG. 1*b* shows a cut-away section of a known magnet with magnetic field lines shown.

FIG. 1*a* shows a known permanent magnet 1. FIG. 1*b* shows a cut section of the magnet 1 along a plane 2 through the middle of the magnet with some schematic magnetic lines indicated with dash dotted lines. The shown magnet is rectangular and symmetrically polarized with a north pole, denoted with an N, and a south pole, denoted with an S. The magnet can be made from any suitable material.

Below, when a magnetic arrangement is described and shown as a cut section, it is a similar cut through the middle of the magnetic arrangement that is used to illustrate the magnetic arrangement with schematic magnetic lines, also indicated with dash dotted lines. It is also assumed that the magnetic field is symmetrical along its symmetry axis 7 which coincides with a centerline running from N to S in the middle of the magnet.

Figure 2A:
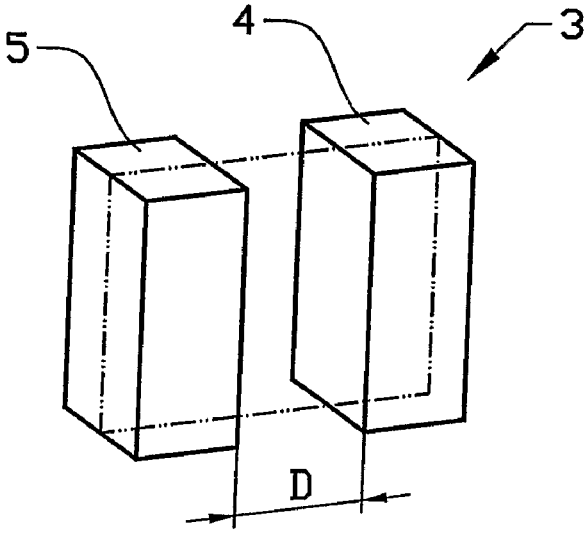
FIG. 2*a* shows a magnetic arrangement configured according to the present invention.

In FIG. 2*a*, a magnetic arrangement 3 comprising two permanent magnets 4, 5 is shown. Preferably, the magnets have approximately the same magnetic properties. It is advantageous if the magnets are made out of the same material and have the same geometric outline, but some deviations are acceptable. As the skilled person will appreciate, the terms "equal" or "the same" for the magnetic properties of permanent magnets will have the meaning "as close as possible" or "approximately the same" due to the nature and to the production process of permanent magnets.

The magnets 4, 5 are equally polarized and positioned next to each other in a symmetrical way with their symmetry axes 7 parallel and with the polarization in the same direction, as can be seen in FIG. 2*a*. The distance between the magnets is denoted with D. Positioned in this way, the magnets will repulse each other, and more specific the north pole of magnet 4 will repulse the north pole of magnet 5 and the south pole of magnet 4 will repulse the south pole of magnet 5. Because the magnets are fixed in relation to each other, the magnetic force between the magnets cannot move the magnets. Instead, the magnetic field from the magnets will deform symmetrically in respect to a plane in between the magnets, indicated as the centerline 6 in FIG. 2*b*.

In this example, rectangular magnets are used. The size of the magnets depends on e.g. the desired magnetic field strength. Depending on the desired magnetic field, other geometric shapes are also possible such as bars where one side is much longer than the other sides or circular ring magnets are possible to use. It is important that the magnets are positioned so that they repulse each other, preferably with the north pole and south pole positioned next to each other, side by side. The sides closest to each other are preferably flat.

Figure 2B:
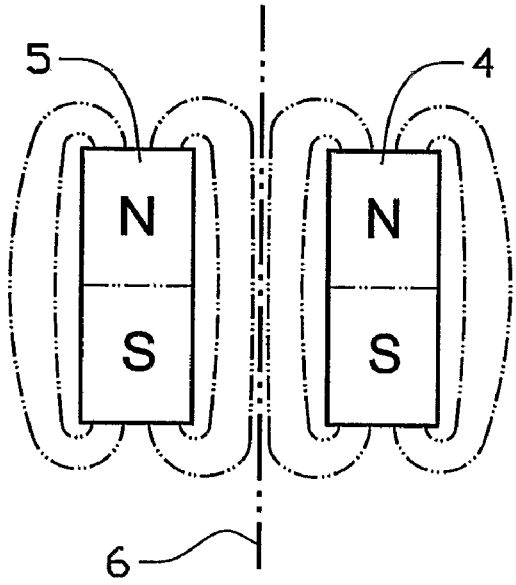
FIG. 2*b* shows a cut-away section of the magnetic arrangement according to FIG. 2*a* and with magnetic field lines shown.
Figure 3A:
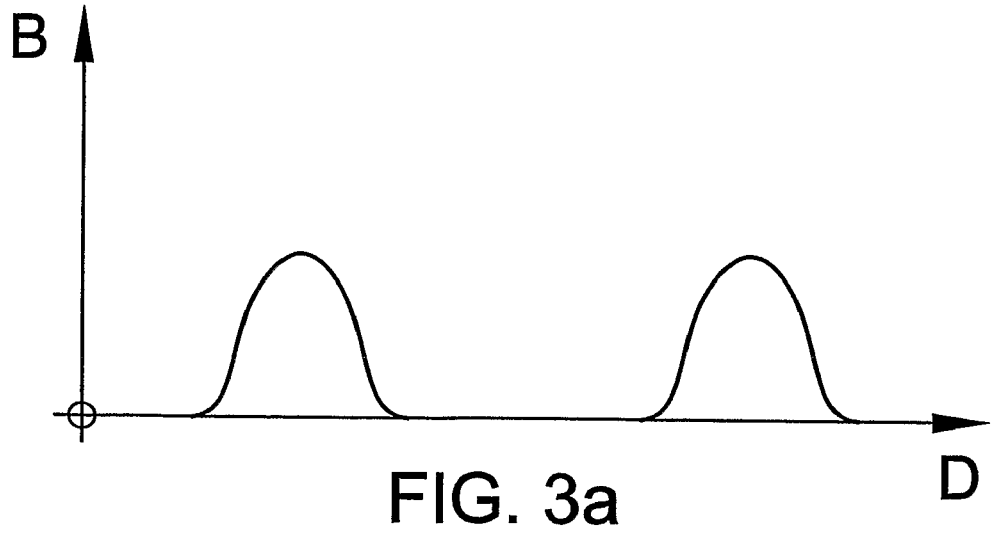
FIGS. 3*a*-3*c* show a schematic relationship between the magnetic flux density B for a magnet and the distance D.
Figure 3B:
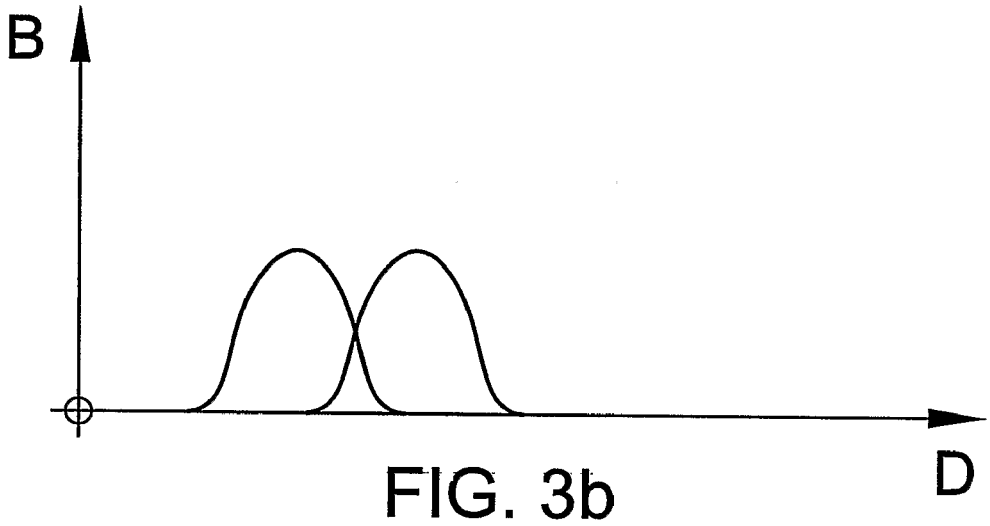
Figure 3C:
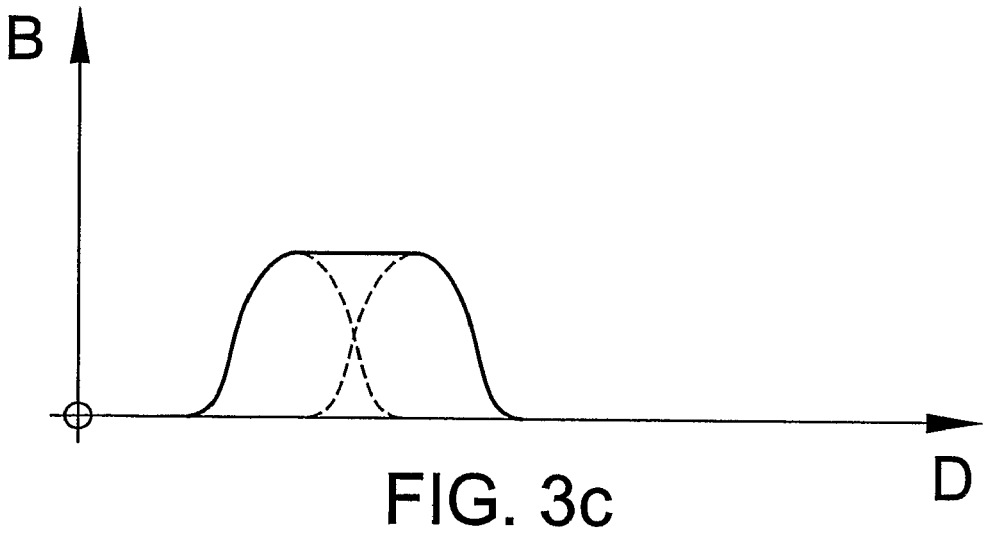

In FIG. 2*b*, the magnetic field lines are deformed somewhat. When the distance D between the magnets is decreased, the magnets will repulse each other and the outer magnetic field at the north and south pole will increase; that is, the magnetic flux density will increase. A schematic relationship between the magnetic flux density B for a magnet and the distance D is shown in FIGS. 3*a*-3*c*. FIG. 3*a* shows the magnetic flux density B for two magnets at a distance when the magnets do not affect each other.

At a certain distance, the magnetic flux density B will superimpose so that the magnetic field will be approximately equal between the symmetry axes 7 of the magnets. At this distance, the magnetic field will be as wide as possible with an equal density. This distance is denoted as the critical distance d. If the distance D is decreased further, the magnetic flux density B will continue to superimpose and when the magnets touch, the magnetic field will equal that of a single magnet with the size of the two magnets combined.

FIG. 3*b* shows the magnetic flux density B for two magnets at the critical distance d where the magnetic field will be approximately equal and as wide as possible. The resulting magnetic field from FIG. 3*b* can be seen in FIG. 3*c*.

The critical distance d depends on various magnetic properties of the magnets. The critical distance d is small compared to the magnets. As an example, the critical distance d for two ceramic type magnets with the size 12*6*4 mm can be approximately 0.9 mm. The easiest way to obtain the critical distance d is by empirical measurements.

The appearance of the magnetic flux density along line 6, i.e. how pointed the magnetic flux density is, can be altered somewhat by adjusting the distance D. At the critical distance d, the magnetic flux density is as flat and wide as possible. In some cases, it may be desirable to have a magnetic flux density that is somewhat wider and not as flat. For instance, if the magnetic arrangement is to be used for a magnetic switch, the switch can obtain a larger tolerance with a magnetic flux density that is somewhat altered. In this case, the distance between the magnets is extended somewhat.

This well-defined magnetic field can be used in a number of applications, of which a few will be described below. Preferably, the magnetic arrangement is used for various contactless detectors.

Figure 4A:
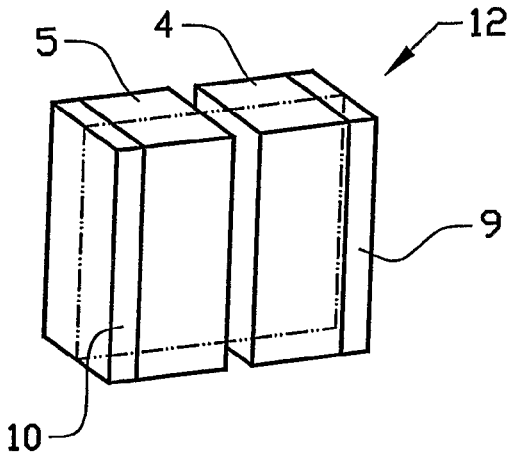
FIG. 4*a* shows an alternative embodiment of the magnetic arrangement of the present invention.

One way to improve the magnetic arrangement 3 as shown above is to use pole-pieces. FIG. 4*a*, shows a magnetic arrangement 12 comprising two magnets 4, 5 and two pole-pieces 9, 10. Preferably, the magnets have approximately the same magnetic properties. It is advantageous if the magnets are made out of the same material and have the same geometric outline, but some deviations are acceptable. The resulting effect is a normalization of the magnetic field.

A pole-piece is made of a ferromagnetic material and is positioned at a side of a magnet. A pole-piece will collect and lead the magnetic field through the pole-piece instead of through the air (which, in contrast to a pole-piece, is non-magnetic). This alters the magnetic flux density in that the magnetic field will be concentrated in the pole-piece. Thus, a high magnetic flux density that is embedded in the pole-piece is obtained. The size of a pole-piece corresponds to the magnet at which it is positioned, and the thickness of the pole-piece is configured so that no saturation in the pole-piece occurs.

The pole-pieces 9, 10 are positioned at the outer sides of the magnets; that is, pole-piece 9 is in close contact with the right side of magnet 4 and pole-piece 10 is in close contact with the left side of magnet 5, as can be seen in FIG. 4*a*. The thickness of the pole-pieces is chosen so that no saturation in the pole-piece occurs.

Figure 4B:
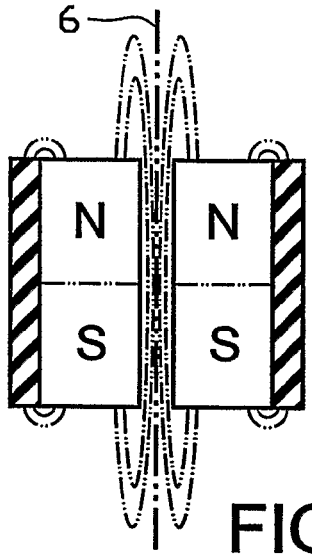
FIG. 4*b* shows a cut-away section of the embodiment of FIG. 4*a* with the magnetic field lines shown.

A schematic view of the resulting arrangement 12 is shown in FIG. 4*b*. In comparison with the arrangement of FIG. 3*b*, the magnetic flux density around the outer sides of the arrangement is concentrated closer to the arrangement. In combination with the in space-dispersed magnetic field obtained in between the magnets, this concentration of magnetic flux density at the outsides of the magnets also helps to reduce disturbing influences from the magnetic field of the magnets. Since the magnetic field from the two outer sides of the magnets are embedded in the pole-pieces and also symmetric, the resulting magnetic field is very stable in geometry.

Figure 5A:
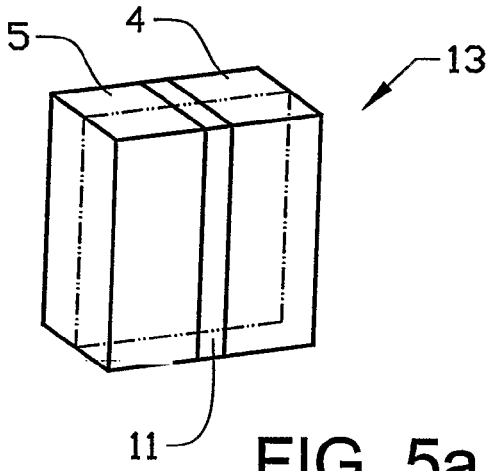
FIG. 5*a* shows an embodiment of the magnetic arrangement included in the invention.
Figure 5B:
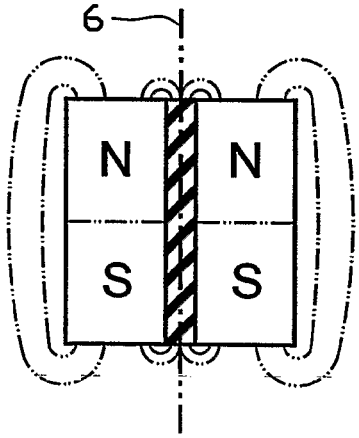
FIG. 5*b* shows a cut-away section of the embodiment of FIG. 5*a* with magnetic field lines shown.

Another magnetic arrangement 13 is shown in FIG. 5*a*, where the magnetic arrangement 13 comprises two magnets 4, 5 and a pole-piece 11. Preferably, the magnets have approximately the same magnetic properties. It is advantageous if the magnets are made out of the same material and have the same geometric outline, but some deviations are acceptable.

The pole-piece 11 is laminated between and in contact with the two magnets 4, 5. The thickness of the pole-pieces is chosen so that no saturation in the pole-piece occurs.

The pole-piece 11 will collect and lead the magnetic field through the pole-piece instead of through the air (which, in contrast to a pole-piece, is non-magnetic). This alters the magnetic field around the centerline 6 in that the magnetic field will be more concentrated. Thus, a high magnetic flux density that is embedded in the pole-piece is obtained. This type of magnetic arrangement can be used, for example, in combination with a linear displacement sensor comprising a coil where a soft magnetic core is to be saturated. The saturation area of the core influences the coil such that the position of the saturated area, and thus the piston in a hydraulic cylinder can de detected.

Figure 6A:
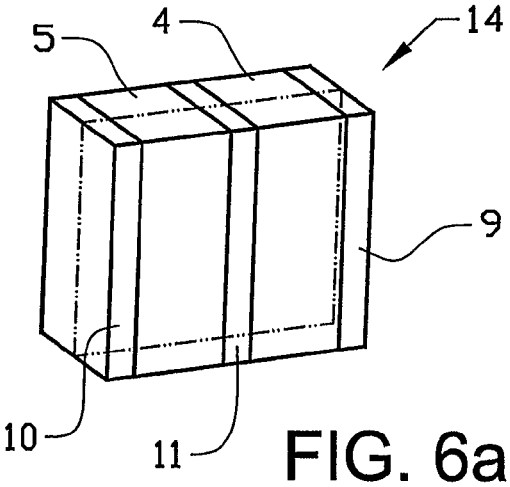
FIG. 6*a* shows an embodiment of the magnetic arrangement included in the invention.
Figure 6B:
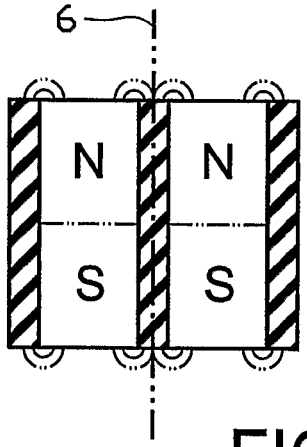
FIG. 6*b* shows a cut-away section of the embodiment of FIG. 6*a* with magnetic field lines shown.

Another magnetic arrangement 14 is shown in FIG. 6*a* where the magnetic arrangement 14 comprises two magnets 4, 5 and three pole-pieces 9, 10 and 11. Preferably, the magnets have approximately the same magnetic properties. It is advantageous if the magnets are made out of the same material and have the same geometric outline, but some deviations are acceptable.

The pole-pieces 9 and 10 are positioned to the outer sides of the magnets; that is, pole-piece 9 is in close contact with the right side of magnet 4 and pole-piece 10 is in close contact with the left side of magnet 5. The thickness of the pole-pieces 9, 10 are chosen so that no saturation in the pole-pieces occurs. The pole-piece 11 is laminated between and in contact with the two magnets 4, 5. The thickness of pole-piece 11 is chosen so that no saturation in the pole-piece occurs. With this embodiment, a high magnetic dispersed flux density that is more equally distributed is obtained. Above, different approaches using a magnetic arrangement for obtaining a well-defined magnetic field are described. These magnetic arrangements are preferably used in magnetic switches.

In the above magnetic arrangements, it is assumed that the magnetic field of a magnet is symmetrical along its symmetry axis 7, a centerline running from N to S in the middle of the magnet. This is, however, rarely the case for normal production permanent magnets. Instead, the direction of the magnetic field deviates with an angle in respect to the symmetry axis 7. This deviation is normally comparably small, in the region up to 10 degrees, but can be as high as 30 degrees. This deviation in turn affects the function of a magnetic switch or a magnetic sensor where such a magnet is used. The described magnetic arrangements can partly compensate for this deviation.

To improve such a magnetic arrangement further, the deviation of the magnetic field direction can be compensated further. This is done by placing the magnets such that the deviation of one magnet compensates for the deviation of the other magnet. In one example, the magnets have a deviation of 20 degrees relative the symmetry axis. By placing the magnets such that the magnetic field of one magnet deviates with 20 degrees in one direction (e.g. away from the centerline in FIG. 2*b*) and the magnetic field of the other magnet deviates with 20 degrees in the other direction. Here, the deviation is also away from the centerline in FIG. 2*b* and the resulting magnetic field will be symmetric with respect to the centerline 6; i.e., to the center of the magnetic arrangement. By placing the magnets so that the deviation of the magnets is in the direction towards the centerline will also create a symmetric magnetic field. The critical distance d may vary slightly depending of the magnetic field deviation of the magnets.

Since it is difficult to detect the deviation of the magnetic field for a single magnet, especially in a production plant, one way of obtaining a symmetric magnetic field is to start with one magnet having the size of the two desired magnets. By splitting the magnet along the center in a north-south direction and turning one of the resulting magnets 180 degrees around the symmetric axis, the resulting magnetic field from the resulting magnetic arrangement will always be symmetric, regardless of the deviation of the magnetic field in the single starting magnet.

Using the same method, it is also possible to create a magnetic arrangement that resembles a single magnet but where the direction of the magnetic field is parallel with the symmetry axis. This is done as described above, the difference being that the magnets are positioned together after the splitting; i.e., the critical distance is close to or equal to zero. Regardless of the deviation of the magnetic field in the starting magnet, the resulting magnetic field will always be symmetric.

Figure 7:
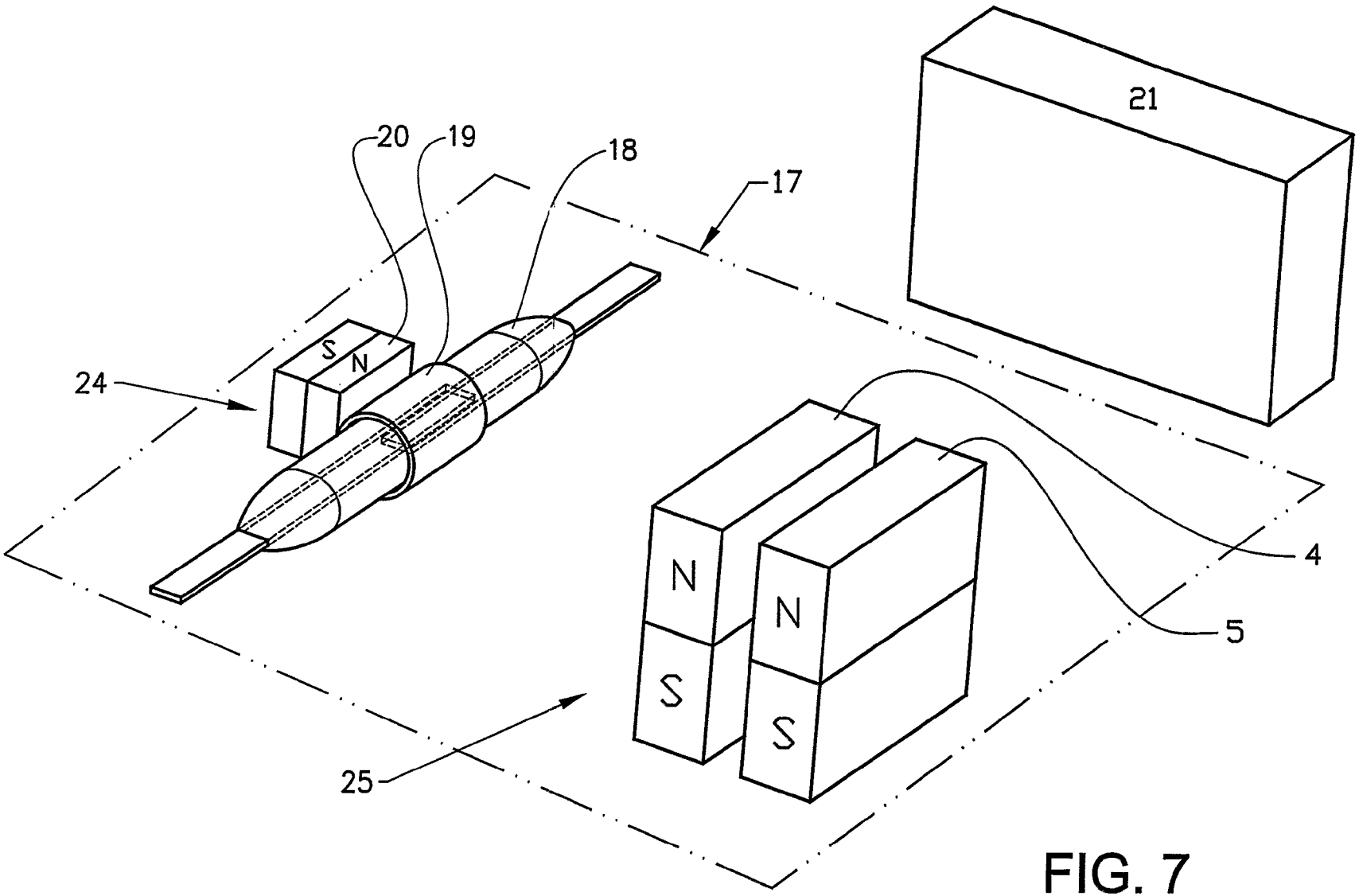
FIG. 7 shows a first embodiment of the inventive magnetic switch configured according to the presently disclosed invention.

In a first embodiment of an inventive magnetic switch 17 configured according to the invention and as shown in FIG. 7, the switch comprises a second magnetic system 25 consisting of two magnets 4, 5, a first magnetic system 24 consisting of a biasing magnet 20 and an assembler 19, and a magnetically sensitive switching element 18. The switching element can be, for instance, a reed-contact or an integrated circuit-based switching element. The switching element is connected to an electrical circuit (not shown) that detects the state of the switching element. The biasing magnet 20 is positioned close to the switching element 18 and biases the switching element. This biasing magnetic field is strong enough to alter the state of the switching element. Because of the close distance to the switching element, the biasing magnet 20 can be relatively small. Preferably, the biasing magnet 20 has a lower magnetic strength than the magnets 4, 5.

The assembler 19 is a device which, as illustrated in FIG. 7, may be a thin-walled tube that surrounds the magnetically sensitive switching element 18 in close proximity to it. The assembler 19 is used to assemble all field lines in a uniform way so that the magnetic field from a permanent magnet positioned outside of the assembler is converted into a longitudinal field inside the assembler. The magnetic field inside the assembler displays identical field directionality regardless of the direction of the magnetic field from the used biasing magnet and thus allows for an identical reproducibility of the magnetic field inside the assembler. A magnetic switching element placed inside the assembler will thus always be subjected to the same magnetic field regardless of the angular response of the detector element. This eliminates the need of having to position an asymmetrically responding magnetic switching element in a specific rotational position along its longitudinal axis. The assembler is preferably made of a soft ferromagnetic material. The biasing magnet 20 is positioned close to or in contact with the assembler. This allows for a relatively small biasing magnet and makes the biasing of the magnetic switching element less sensitive for external interference.

The two permanent magnets 4, 5, are positioned at a distance from the magnetic switching element 18 so that the magnetic field from the magnets 4, 5 interacts with the biasing magnetic field at the magnetic switching element. The switch is designed as one unit, with the magnets and the magnetic switching element integrated in the same housing. In the embodiments described here, a normally open reed-contact is used as the magnetic switching element. This is the most common type of reed-contact and it is also the least expensive type. Other types, such as changeover or normally closed reed-contacts, can also be used when required.

In the first embodiment, the switch is switched by disturbing the magnetic field of the magnets 4, 5 with a ferromagnetic material 21. In this embodiment, the magnets 4, 5, are positioned at a distance from the reed-contact so that the magnetic field from the magnets 4, 5 cancels the biasing magnetic field at the reed-contact. This leaves the reed-contact in its normal, open state. The resulting magnetic field over the reed-contact will thus be close to zero, or at least under the threshold level of the reed-contact.

When the ferromagnetic material 21 is introduced into the magnetic field of magnets 4, 5; that is, when the ferromagnetic material 21 approaches the magnetic switch, the material 21 will collect some of the magnetic field which means that the magnetic field from the magnets 4, 5 at the reed-contact will decrease. When the ferromagnetic material is at a certain distance, the magnetic field from magnets 4, 5 has decreased enough for the biasing field to close the reed-contact; i.e., the switch switches. The switch is, for example, suitable for mounting on a truck and the ferromagnetic material could be a door. In this case, the switch detects that the door is closed. This embodiment provides for a normally open switch that is closed e.g. by bringing the door close to the switch.

In a second embodiment, the switch is also switched by disturbing the magnetic field of the magnets 4, 5 with a ferromagnetic material 21. In this embodiment, the magnets 4, 5, are positioned somewhat closer to the reed-contact so that the magnetic field from the magnets 4, 5 overcomes the biasing magnetic field enough for the reed-contact to close. The resulting magnetic field over the reed-contact is thus at least over the threshold level of the reed-contact.

When the ferromagnetic material 21 is introduced into the magnetic field of magnets 4, 5 (that is, when the ferromagnetic material 21 approaches the magnetic switch), the material 21 will collect some of the magnetic field, which means that the magnetic field from the magnets 4, 5 at the reed-contact will decrease. When the ferromagnetic material is at a certain distance, the magnetic field from magnets 4, 5 has decreased so much that it is balanced by the biasing magnetic field. The resulting magnetic field over the reed-contact will thus be under the threshold level of the reed-contact, which opens the reed-contact; i.e., the switch switches. The switch is, for example, suitable for mounting on a truck and the ferromagnetic material can be something such as a door of the vehicle. In this case, the switch detects that the door is closed. This embodiment provides for a normally closed switch that is opened, for example, by bringing the door close to the switch.

In a third embodiment, the switch is switched by removing a ferromagnetic material 21 from the switch. In this embodiment, the balance between the biasing magnetic field and the magnetic field from magnets 4, 5 at the reed-contact is set up with a ferromagnetic material 21 close to the switch. In this embodiment, the magnets 4, 5 are positioned at a distance from the reed-contact so that the magnetic field from the magnets 4, 5 together with the ferromagnetic material 21 cancels the biasing magnetic field at the reed-contact. This leaves the reed-contact in its normal, open state. The resulting magnetic field over the reed-contact will thus be close to zero, or at least under the threshold level of the reed-contact.

When the ferromagnetic material is removed from the switch, that is when the ferromagnetic material 21 is moved away from the switch, the balance between the biasing magnetic field and the magnetic field from magnets 4, 5 at the reed-contact disappears. In this case, the magnetic field of the magnets 4, 5 will increase enough to close the reed-contact, i.e. the switch switches. The switch is e.g. suitable for mounting on a truck and the ferromagnetic material can be e.g. a door. In this case, the switch detects that the door is opened.

In a fourth embodiment, the switch is also switched by removing a ferromagnetic material 21 from the switch. In this embodiment, the balance between the biasing magnetic field and the magnetic field from magnets 4, 5 at the reed-contact is set up with a ferromagnetic material 21 close to the switch. In this embodiment, the magnets 4, 5 are positioned so that the magnetic field from the magnets 4, 5 together with the ferromagnetic material is less than the biasing magnetic field so that the reed-contact is closed by the biasing magnetic field. The resulting magnetic field over the reed-contact is thus lower than the threshold level of the reed-contact.

When the ferromagnetic material is removed from the switch, that is when the ferromagnetic material 21 is moved away from the switch, a balance between the biasing magnetic field and the magnetic field from magnets 4, 5 at the reed-contact is created. In this case, the magnetic field of the magnets 4, 5 will increase enough to open the reed-contact; that is, the switch switches. The switch is therefore suitable for mounting on a truck and the ferromagnetic material can be suitably a door. In this case, the switch detects that the door is opened.

The above-described switches are suitable for contactless detection of the position of metallic parts on e.g. vehicles. Since the magnetic switch is enclosed in a single housing, it is protected against corrosion, dirt and the like. Thus, the switch is especially suitable for the detection of safety critical parts.

This can, for example, be to detect if the cab is in a locked position, to detect if the storage doors are closed or to detect if a tipper body is in a rest position. If the part to detect is not made of a ferromagnetic material, a ferromagnetic material can easily be fitted to the part, either by applying it on the surface or by integrating it into the part.

In a further embodiment, a single magnet replaces the two magnets 4, 5. The single magnet is positioned in a similar manner as described above for the magnetic arrangement with magnets 4, 5. To use a single magnet requires a good knowledge of the properties of the used magnet. In production, where the magnetic properties of the used magnets vary considerably not only between different batches but also in the same production batch, it can be difficult to ensure that the magnetic field from the single magnet always balances the biasing magnetic field. Thus, in production it is advantageous to use a magnetic arrangement with two magnets to obtain a good reproducibility.

In a further embodiment, the magnetic switching element is used without the assembler. If the angular response of the magnetic switching element is known and it is possible to position the magnetic switching element in a reproducible predefined position, the switch will work as described above without the assembler. In production, it is advantageous to use an assembler. This ensures that the biasing magnetic field will affect the magnetic switching element in a predefined manner.

In the above magnetic switches, any of the magnetic arrangements described above can be advantageous, depending on the requirements.

It should be appreciated that the invention is not to be regarded as being limited to the embodiments described above; a number of additional variants and modifications being possible within the scope of the subsequent patent claims. The magnetic switch arrangement can be used wherever a contactless detection is required.

What is claimed is:

1. A magnetic switch arrangement comprising:

a first magnetic system (24);

a second magnetic system (25) disposed in fixed relation to the first magnetic system (24); and a magnetically responsive switching element (18) disposed in fixed relation to said first and second magnetic systems (24, 25);

wherein said first magnetic system (24) is arranged for biasing the magnetically responsive switching element (18) into a predefined state and the second magnetic system (25) is arranged such that its magnetic field interacts with the biasing magnetic field from the first magnetic system (24) at the magnetically responsive switching element so that the magnetically responsive switching element assumes said predefined state, the arrangement of said first magnetic system (24), said second magnetic system (25), and said magnetically responsive switching element (18) further being such that a change in the spatial distribution of the second magnetic system's magnetic field caused by a ferromagnetic material being brought near or being moved away from said second magnetic system (25) causes said magnetically responsive switching element (18) to assume a state other than said predefined state; and wherein said first magnetic system (24) comprises a magnetic field assembler (19) arranged for creating a longitudinal magnetic field inside the assembler, the assembler (19) comprising a thin-walled tube of ferromagnetic material surrounding the magnetically responsive switching element (18) in close proximity to it.

2. The magnetic switch arrangement as recited in claim 1, wherein the second magnetic system (25) comprises two equally polarized permanent magnets (4, 5) positioned at a fixed distance apart.

3. The magnetic switch arrangement as recited in claim 1, wherein the first magnetic system (24) comprises a single permanent magnet (20).

4. The magnetic switch arrangement as recited in claim 1, wherein the magnetically responsive switching element (18) is a reed-contact.

5. The magnetic switch arrangement as recited in claim 2, wherein the fixed distance between the permanent magnets (4, 5) of said second magnetic system (25) is a critical distance (d).

6. The magnetic switch arrangement as recited in claim 2, wherein the fixed distance between the magnets (4, 5) of said second magnetic system (25) is close to or equal to zero.

7. The magnetic switch arrangement as recited in claim 2, wherein the space between the magnets (4, 5) of said second magnetic system (25) is filled with a non-magnetic material.

8. The magnetic switch arrangement as recited in claim 2, wherein the space between the magnets (4, 5) of said second magnetic system (25) is filled with a ferro-magnetic material.

9. The magnetic switch arrangement as recited in claim 2, wherein the magnets (4, 5) of said second magnetic system (25) have ferro-magnetic material on sides opposite the space therebetween.

10. The magnetic switch arrangement as recited in claim 2, wherein the magnets (4, 5) of said second magnetic system (25) are positioned such that any deviation in the magnetic field direction in respect to a symmetry axis (7) for each magnet (4, 5) is symmetric in respect to a central line (6) between the magnets (4, 5) of the second magnetic system.

11. The magnetic switch arrangement as recited in claim 2, wherein the magnets (4, 5) of said second magnetic system (25) have been obtained by dividing a single magnet into two equal parts along a line parallel to a symmetry axis (7) and wherein one magnet has been rotated 180 degrees around its symmetry axis (7).

12. The magnetic switch arrangement as recited in claim 1, wherein the magnetic switch arrangement is integrated within a single housing.

* * * * *